US007032478B2

(12) United States Patent
Hu

(10) Patent No.: US 7,032,478 B2
(45) **Date of Patent: *Apr. 25, 2006**

(54) RATCHETING WRENCH WITH QUICK TIGHTENING/LOOSENING FUNCTIONS AND FINE ADJUSTING FUNCTIONS

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/160,725

(22) Filed: Jul. 6, 2005

(65) Prior Publication Data

US 2005/0229751 A1 Oct. 20, 2005

Related U.S. Application Data

(63) Continuation of application No. 10/624,624, filed on Jul. 22, 2003, now Pat. No. 6,971,286.

(30) Foreign Application Priority Data

Jul. 22, 2002 (TW) ..... 91116461 A

(51) Int. Cl.
*B25B 13/00* (2006.01)

(52) U.S. Cl. ..... 81/63.2; 81/124.3

(58) Field of Classification Search ..... 81/58.1, 81/60–63.2, 176.15, 176.2, 125, 124.3, 124.7
See application file for complete search history.

(56) References Cited

U.S. PATENT DOCUMENTS

| | | | |
|---|---|---|---|
| 15,482 | A | 8/1856 | Gilman |
| 726,012 | A | 4/1903 | Andrew |
| 810,599 | A | 1/1906 | Ansorge |
| 818,761 | A | 4/1906 | Hanes et al. |
| 841,686 | A | 1/1907 | Hatfield |
| 878,657 | A | 2/1908 | Munch |
| 893,097 | A | 7/1908 | Reams |
| 915,446 | A | 3/1909 | Kearnes |
| RE13,205 | E | 2/1911 | Lane |
| 1,033,358 | A | 7/1912 | Turner |
| 1,078,059 | A | 11/1913 | Mossberg |

(Continued)

FOREIGN PATENT DOCUMENTS

| | | |
|---|---|---|
| DE | 373436 | 4/1923 |

(Continued)

OTHER PUBLICATIONS

EPO Search Report for Appln. No. EP 00 12 6902 dated Feb. 17, 2003 (3p.) 0570.

(Continued)

*Primary Examiner*—David B. Thomas
(74) *Attorney, Agent, or Firm*—Alan D. Kamrath; Nikolai & Mersereau, P.A.

(57) ABSTRACT

A ratcheting wrench includes a handle, a head extending from an end of the handle and having a hole communicated with a compartment in the end of the handle, a drive member rotatably mounted in the hole of the head, and a ratcheting mechanism. The drive member includes an inner periphery for securely holding a fastener-driving member, allowing joint rotation when the drive member is turned. The drive member further includes a flange formed on an end of an outer periphery thereof and located outside the head for manual rotation of the drive member. The ratcheting mechanism is mounted in the compartment of the handle and engaged with the teeth of the drive member, allowing the handle to selectively move in a ratcheting direction for tightening/loosening a fastener and in a free turning direction reverse to the ratcheting direction in which the fastener is not turned.

23 Claims, 17 Drawing Sheets

U.S. PATENT DOCUMENTS

| | | | |
|---|---|---|---|
| 1,090,578 | A | 3/1914 | Smythe |
| 1,194,471 | A | 8/1916 | Boosinger |
| 1,261,092 | A | 4/1918 | Allen |
| 1,382,492 | A | 6/1921 | Evans |
| 1,426,127 | A | 8/1922 | Tuttle |
| 1,601,767 | A | 10/1926 | Peterson |
| 1,614,039 | A | 1/1927 | Mandl |
| 1,639,078 | A | 8/1927 | Coe |
| 1,680,515 | A | 8/1928 | Gormley |
| 1,772,524 | A | 8/1930 | Seidemann |
| 1,957,462 | A | 5/1934 | Kress |
| 2,193,984 | A | 3/1940 | Rhinevault |
| 2,201,705 | A | 5/1940 | Stone |
| 2,201,827 | A | 5/1940 | Froeschl et al. |
| 2,317,461 | A | 4/1943 | Jackson |
| 2,320,044 | A | 5/1943 | Merriman |
| 2,542,241 | A | 2/1951 | Fors |
| 2,612,807 | A | 10/1952 | Hunt |
| 2,657,604 | A | 11/1953 | Rueb |
| 2,701,977 | A | 2/1955 | Stone |
| 2,735,324 | A | 2/1956 | Goldwater et al. |
| 2,764,048 | A | 9/1956 | Thompson |
| 2,769,360 | A | 11/1956 | Cottrell et al. |
| 2,800,821 | A | 7/1957 | Fruscella |
| 2,801,561 | A | 8/1957 | Bonner |
| 2,803,980 | A | 8/1957 | Vogel |
| 2,805,594 | A | 9/1957 | Fogel |
| 2,806,706 | A | 9/1957 | Fitch |
| 2,880,637 | A | 4/1959 | Koenig |
| 2,891,434 | A | 6/1959 | Lozensky |
| 2,957,377 | A | 10/1960 | Hare |
| 2,978,081 | A | 4/1961 | Lundin |
| 3,019,682 | A | 2/1962 | Hare |
| 3,044,591 | A | 7/1962 | Kilness |
| 3,233,481 | A | 2/1966 | Bacon |
| 3,250,157 | A | 5/1966 | Badger |
| 3,265,171 | A | 8/1966 | Kilness |
| 3,269,496 | A | 8/1966 | Kilness |
| 3,337,014 | A | 8/1967 | Sandrick |
| 3,342,229 | A | 9/1967 | Janes |
| 3,347,293 | A | 10/1967 | Clark |
| 3,393,587 | A | 7/1968 | Jolliff et al. |
| 3,393,780 | A | 7/1968 | Kilness |
| 3,436,992 | A | 4/1969 | Over et al. |
| 3,508,455 | A | 4/1970 | Miller |
| 3,575,069 | A | 4/1971 | White |
| 3,577,816 | A | 5/1971 | Alexander et al. |
| 3,598,001 | A | 8/1971 | Thomasian |
| 3,606,940 | A | 9/1971 | Finkeldei |
| 3,691,876 | A | 9/1972 | Cassidy, Jr. |
| 3,713,356 | A | 1/1973 | Knudsen |
| 3,742,788 | A | 7/1973 | Priest |
| 3,783,703 | A | 1/1974 | Trimble et al. |
| 3,838,614 | A | 10/1974 | O'Donnell |
| 3,866,492 | A | 2/1975 | Knoll |
| 3,908,487 | A | 9/1975 | Plaw |
| 3,970,155 | A | 7/1976 | Otto |
| 4,053,037 | A | 10/1977 | Solomon |
| 4,070,932 | A | 1/1978 | Jeannotte |
| 4,111,077 | A | 9/1978 | Cummings et al. |
| 4,128,025 | A | 12/1978 | Main et al. |
| 4,147,076 | A | 4/1979 | Wright et al. |
| 4,257,507 | A | 3/1981 | Solomon |
| 4,274,311 | A | 6/1981 | Ebert |
| 4,277,989 | A | 7/1981 | Tracy |
| 4,277,990 | A | 7/1981 | Hall |
| 4,308,768 | A | 1/1982 | Wagner |
| 4,308,769 | A | 1/1982 | Rantanen |
| 4,328,720 | A | 5/1982 | Shiel |
| 4,336,728 | A | 6/1982 | Diebert |
| 4,406,186 | A | 9/1983 | Gummow |
| 4,420,995 | A | 12/1983 | Roberts |
| 4,485,700 | A | 12/1984 | Colvin |
| 4,488,460 | A | 12/1984 | Ballone et al. |
| 4,512,218 | A | 4/1985 | Chow |
| 4,520,697 | A | 6/1985 | Moetteli |
| 4,631,988 | A | 12/1986 | Colvin |
| 4,662,251 | A | 5/1987 | Kohal |
| 4,709,600 | A | 12/1987 | Mierbach et al. |
| 4,722,252 | A | 2/1988 | Fulcher et al. |
| 4,722,253 | A | 2/1988 | Chow |
| 4,762,033 | A | 8/1988 | Chow |
| 4,770,072 | A | 9/1988 | Neuhaus |
| 4,777,852 | A | 10/1988 | Herman et al. |
| 4,796,492 | A | 1/1989 | Liou |
| 4,807,500 | A | 2/1989 | Main |
| 4,862,775 | A | 9/1989 | Chow |
| 4,869,138 | A | 9/1989 | Farris |
| 4,903,554 | A | 2/1990 | Colvin |
| 4,924,737 | A | 5/1990 | Gummow |
| 4,934,220 | A | 6/1990 | Slusar et al. |
| 4,986,147 | A | 1/1991 | Cooper |
| 4,991,468 | A | 2/1991 | Lee |
| 5,000,066 | A | 3/1991 | Gentiluomo |
| 5,012,705 | A | 5/1991 | Chow |
| 5,038,452 | A | 8/1991 | Beugelsdyk et al. |
| 5,076,121 | A | 12/1991 | Fosella |
| 5,095,781 | A | 3/1992 | Blake |
| 5,144,869 | A | 9/1992 | Chow |
| 5,157,994 | A | 10/1992 | Krivec |
| 5,178,047 | A | 1/1993 | Arnold et al. |
| 5,199,330 | A | 4/1993 | Arnold et al. |
| 5,199,335 | A | 4/1993 | Arnold et al. |
| 5,230,262 | A | 7/1993 | Ahlund et al. |
| 5,231,903 | A | 8/1993 | Bockman, Jr. |
| 5,233,891 | A | 8/1993 | Arnold et al. |
| 5,271,300 | A | 12/1993 | Zurbuchen et al. |
| 5,295,422 | A | 3/1994 | Chow |
| 5,347,892 | A | 9/1994 | Moetteli |
| 5,392,672 | A | 2/1995 | Larson et al. |
| 5,404,773 | A | 4/1995 | Norville |
| 5,425,291 | A | 6/1995 | Chang |
| 5,448,931 | A | 9/1995 | Fosella et al. |
| 5,467,672 | A | 11/1995 | Ashby |
| 5,477,757 | A | 12/1995 | Maresh |
| 5,495,783 | A | 3/1996 | Slusar et al. |
| 5,499,560 | A | 3/1996 | Aeschliman |
| 5,501,124 | A | 3/1996 | Ashby |
| 5,509,333 | A | 4/1996 | Rion |
| 5,522,288 | A | 6/1996 | Slusar et al. |
| 5,533,427 | A | 7/1996 | Chow |
| 5,535,646 | A | 7/1996 | Allen et al. |
| 5,557,994 | A | 9/1996 | Nakayama |
| 5,582,081 | A | 12/1996 | Lin |
| 5,584,220 | A | 12/1996 | Darrah et al. |
| 5,595,095 | A | 1/1997 | Hillinger |
| 5,622,089 | A | 4/1997 | Gifford, Sr. |
| 5,626,061 | A | 5/1997 | Whitley |
| 5,626,062 | A | 5/1997 | Colvin |
| 5,636,557 | A | 6/1997 | Ma |
| 5,669,875 | A | 9/1997 | Van Eerdenburg |
| 5,709,137 | A | 1/1998 | Blacklock |
| 5,749,272 | A | 5/1998 | Phan |
| 5,782,147 | A | 7/1998 | Chaconas et al. |
| 5,791,848 | A | 8/1998 | Lanham |
| 5,794,496 | A | 8/1998 | Arnold |
| 5,829,326 | A | 11/1998 | Richner |
| 5,842,391 | A | 12/1998 | Chaconas |
| 5,857,390 | A | 1/1999 | Whiteford |
| 5,873,286 | A | 2/1999 | Van Lenten |
| 5,878,635 | A | 3/1999 | Hsieh |
| 5,884,537 | A | 3/1999 | Chen |
| 5,884,538 | A | 3/1999 | Van Lenten |
| 5,887,493 | A | 3/1999 | Main |

| | | | |
|---|---|---|---|
| 5,901,620 | A | 5/1999 | Arnold |
| 5,910,197 | A | 6/1999 | Chaconas |
| 5,911,798 | A | 6/1999 | Arnold |
| 5,913,954 | A | 6/1999 | Arnold et al. |
| 5,927,158 | A | 7/1999 | Lin |
| 5,946,987 | A | 9/1999 | Wei |
| 5,946,989 | A | 9/1999 | Hsieh |
| 5,957,009 | A | 9/1999 | McCann |
| 5,964,129 | A | 10/1999 | Shiao |
| 5,970,552 | A | 10/1999 | Kwiecien et al. |
| 5,979,274 | A | 11/1999 | Hsieh |
| 5,996,453 | A | 12/1999 | Blacklock |
| 6,000,302 | A | 12/1999 | Chiang |
| 6,006,631 | A | 12/1999 | Miner et al. |
| 6,044,731 | A | 4/2000 | Hsieh |
| 6,065,374 | A | 5/2000 | Taggart |
| 6,125,722 | A | 10/2000 | Hopper, Jr. et al. |
| 6,134,990 | A | 10/2000 | Ling et al. |
| 6,134,991 | A | 10/2000 | Chaconas |
| D433,896 | S | 11/2000 | Wei |
| D434,292 | S | 11/2000 | Hsieh |
| 6,148,695 | A | 11/2000 | Hu |
| 6,152,826 | A | 11/2000 | Profeta et al. |
| 6,155,140 | A | 12/2000 | Tsai |
| 6,161,454 | A | 12/2000 | Chaconas |
| 6,164,167 | A | 12/2000 | Chen |
| 6,205,889 | B1 | 3/2001 | Hsieh |
| 6,209,423 | B1 | 4/2001 | Shiao |
| 6,216,563 | B1 | 4/2001 | Hsieh |
| 6,216,567 | B1 | 4/2001 | Hu |
| 6,220,123 | B1 | 4/2001 | Chen |
| 6,230,591 | B1 | 5/2001 | Ling et al. |
| 6,240,813 | B1 | 6/2001 | Hyatt |
| 6,257,096 | B1 | 7/2001 | Ling |
| 6,257,097 | B1 | 7/2001 | I-He |
| 6,260,448 | B1 | 7/2001 | Chaconas |
| 6,260,449 | B1 | 7/2001 | I-He |
| 6,263,767 | B1 | 7/2001 | Hu |
| 6,282,991 | B1 | 9/2001 | Hu |
| 6,282,992 | B1 | 9/2001 | Hu |
| 6,282,993 | B1 | 9/2001 | Forman et al. |
| 6,301,998 | B1 | 10/2001 | Hu |
| 6,308,594 | B1 | 10/2001 | Cheng |
| 6,332,382 | B1 | 12/2001 | Anderson et al. |
| 6,334,373 | B1 | 1/2002 | Hsieh |
| 6,382,051 | B1 | 5/2002 | Chang |
| 6,382,052 | B1 | 5/2002 | Chen |
| 6,386,072 | B1 | 5/2002 | Yuan-Chin et al. |
| 6,427,560 | B1 | 8/2002 | Shea |
| 6,431,031 | B1 | 8/2002 | Hu |
| 6,435,062 | B1 | 8/2002 | McCann |
| 6,435,063 | B1 | 8/2002 | Chen |
| 6,450,066 | B1 | 9/2002 | Hu |
| 6,450,068 | B1 | 9/2002 | Hu |
| 6,453,779 | B1 | 9/2002 | Hu |
| 6,457,387 | B1 | 10/2002 | Hu |
| 6,457,388 | B1 | 10/2002 | Chen |
| 6,457,389 | B1 | 10/2002 | Hu |
| 6,488,136 | B1 | 12/2002 | Chang |
| 6,516,691 | B1 | 2/2003 | Wei |
| 6,520,051 | B1 | 2/2003 | Hu |
| 6,539,825 | B1 | 4/2003 | Lin |
| 6,568,299 | B1 | 5/2003 | Hu |
| 6,591,717 | B1 | 7/2003 | Wei |
| 6,629,477 | B1 | 10/2003 | Ling et al. |
| 6,644,148 | B1 | 11/2003 | Hu |
| 6,647,832 | B1 | 11/2003 | Hu |
| 6,662,693 | B1 | 12/2003 | Hu |
| 6,666,112 | B1 | 12/2003 | Hu |
| 6,666,117 | B1 | 12/2003 | Hu |
| 6,688,195 | B1 | 2/2004 | Hsien |
| 6,701,808 | B1 | 3/2004 | Hsieh |
| 6,708,586 | B1 | 3/2004 | Chen |
| 6,722,234 | B1 | 4/2004 | Hu |
| 6,732,614 | B1 | 5/2004 | Hu |
| 6,745,647 | B1 | 6/2004 | Wang |
| 6,748,825 | B1 | 6/2004 | Hsu |
| 6,758,641 | B1 | 7/2004 | Hu |
| 6,761,092 | B1 | 7/2004 | Hsien |
| 6,807,882 | B1 | 10/2004 | Hu |
| 2002/0023520 | A1 | 2/2002 | Hu |
| 2002/0162423 | A1 | 11/2002 | Hu |
| 2002/0166417 | A1 | 11/2002 | Hu |
| 2002/0166418 | A1 | 11/2002 | Hsieh |
| 2002/0194950 | A1 | 12/2002 | Hu |
| 2003/0010159 | A1 | 1/2003 | Hu |
| 2003/0070512 | A1 | 4/2003 | Hu |
| 2003/0121373 | A1 | 7/2003 | Ling et al. |
| 2003/0154826 | A1 | 8/2003 | Lee |
| 2003/0196522 | A1 | 10/2003 | Hu |
| 2004/0093995 | A1 | 5/2004 | Hu |

FOREIGN PATENT DOCUMENTS

| | | |
|---|---|---|
| DE | 921198 | 7/1949 |
| DE | 1810811 | 6/1970 |
| DE | 2 9907467 | 9/1999 |
| DE | 2 9910932 | 9/1999 |
| FR | 498276 | 1/1920 |
| GB | 1559093 | 1/1980 |
| GB | 2135226 | 8/1984 |
| TW | 130638 | 12/1977 |
| TW | 212343 | 5/1982 |
| TW | 310649 | 1/1986 |
| TW | 290904 | 11/1996 |
| TW | 439625 | 6/2001 |
| TW | 458012 | 10/2001 |
| TW | 488342 | 5/2002 |
| TW | 526807 | 4/2003 |

OTHER PUBLICATIONS

Appeal Brief against Office Action on Opposition to Patent Application No. 089200570 P01 in Taiwan and translation of same.

First Office Action on Patent Application No. 001003289 in People's Republic of China and Translation.

Office Action by Taiwan Intellectual Property Office on Opposition to Patent Application No. 089200570 in Taiwan and Translation; and Translations of Taiwanese Patent Publication No. 212343, of Taiwanese Patent Publication No. 310649, and of Taiwanese Patent Publication No. 130638.

Decision by the Board of Appeal and Translation of same.

Taiwan Intellectual Property Office's Answer to Appeal Brief and Translation of same.

Complaint for Declatory Judgment of Noninfringement, Unenforceability, and Invalidity of a Patent, dated Sep. 26, 2002.

Amended Complaint for Declatory Judgment of Noninfringement, Unenforceability, and Invalidity of a Patent, dated Sep. 19, 2003.

Plaintiff's Second Supplemental Response to Interrogatory No. 3 of Defendant's First Set of Interrogatories, dated Apr. 21, 2004.

Tool and Manufacturing Engineers Handbook, 1976, 3rd Edition, pp. 6-48.

RATCHETING WRENCH WITH QUICK TIGHTENING/LOOSENING FUNCTIONS AND FINE ADJUSTING FUNCTIONS

CROSS REFERENCE

The present application is a continuation of U.S. patent appln. Ser. No. 10/624,624 filed Jul. 22, 2003, now U.S. Pat. No. 6,971,286.

BACKGROUND OF THE INVENTION

1. Field of the Invention

The present invention relates to a ratcheting wrench having a drive member that securely receives a fastener-driving member therein for driving a fastener such as a screw, bolt, or nut.

2. Description of the Related Art

Ratcheting wrenches have been widely used for tightening/loosening fasteners such as screws, bolts, and nuts, and there are a wide variety of types of ratcheting wrenches. Taiwan Utility Model Publication No. 458012 entitled "Improved Socket Wrench" discloses a wrench including a handle and a head in the form of a box end on an end of the handle. A swivel member is rotatably held in the box end. Two pawls are slidably mounted in the box end and each includes a toothed side for releasably meshing with a toothed inner periphery of the box end. The swivel member includes a protrusion on a central portion of an upper side thereof, thereby forming two recessed portions for respectively receiving the pawls. A control button is attached on top of the swivel member and engaged with the pawls. Two elastic elements are provided in a manner that the pawls are moved between a first ratcheting position and a second ratcheting position respectively corresponding to two opposite ratcheting directions in response to pivotal movement of the control button between two positions. The swivel member includes a socket-engaging portion extending beyond the box end for releasably engaging with a socket. However, the pawls are mounted in the box end and thus render a bulky box end such that the wrench cannot be used in a limited space. Further, the swivel member can only be used with sockets; namely, the swivel member cannot be used with other tools such as screwdrivers. Further, the swivel member cannot be used to directly drive fasteners.

FIG. 15 of the drawings illustrates a conventional ratcheting wrench of the type including a handle 7 and a head 2 in the form of a box end. A gear wheel 3 is rotatably held in the head 2 and includes an inner periphery 4 configured to releasably hold a shank of a screwdriver that has a bit 5 for driving a fastener 6. However, when tightening the fastener 6, the user has to repeatedly move the handle 7 back and forth many times, which is time-consuming and laborious. Further, the screwdriver shank is apt to displace relative to the gear wheel 3 and thus may be disengaged from the inner periphery 4 of the head 2, as there is no member for retaining the screwdriver shank in place.

Taiwan Utility Model Publication No. 526807 discloses a ratcheting wrench including a handle and a head in the form of a box end on an end of the handle. A gear wheel is rotatably mounted in the box end and includes a plurality of teeth defined in an outer periphery thereof. A C-clip is partially received in an annular groove in the outer periphery of the gear wheel and partially received in an annular groove defined in an inner periphery of the box end. The gear wheel includes an inner periphery for releasably holding a nut. An end of the gear wheel is exposed outside the box end, and a ring is fixed or integrally formed on the end of the gear wheel, allowing quick tightening/loosening of the nut. However, manufacture and assembly of this ratcheting wrench are troublesome. More specifically, formation of the annular groove in the inner periphery of the box end and mounting of the C-clip into the annular groove of the box end and the annular groove of the gear wheel are not easy and thus increase the manufacturing cost. Further, Taiwan Utility Model Publication No. 526807 fails to disclose use of the ratcheting wrench with a screwdriver and thus provides limited functions.

SUMMARY OF THE INVENTION

An object of the present invention is to provide a ratcheting wrench having a drive member that securely receives a fastener-driving member therein and that has a flange allowing a user to quickly turn the drive member together with the fastener-driving member to quickly drive a fastener and allowing the user to finely turn the drive member and the fastener-driving member when desired.

Another object of the present invention is to provide a ratcheting wrench having a drive member that can be easily manufactured and assembled while providing quick tightening/loosening functions.

In accordance with an aspect of the present invention, a ratcheting wrench comprises:

a handle having an end, the end of the handle having a compartment;

a head extending from the end of the handle and having a hole communicated with the compartment of the handle;

a drive member rotatably mounted in the hole of the head, the drive member including an inner periphery adapted to securely, releasably hold a fastener-driving member, allowing joint rotation of the fastener-driving member and the drive member when the drive member is turned, the drive member further including a plurality of teeth on an outer periphery thereof; and a ratcheting mechanism mounted in the compartment of the handle and engaged with the teeth of the drive member;

an annular groove being defined in the inner periphery of the drive member, a retainer being received in the annular grove for releasably holding the fastener-driving member in place; and the drive member further including a stop on an end of the inner periphery for preventing the fastener-driving member from disengaging from the drive member through the end of the inner periphery of the drive member.

In further aspects, the drive member further includes a flange formed on an end of an outer periphery thereof and located outside the head for manual rotation of the drive member.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
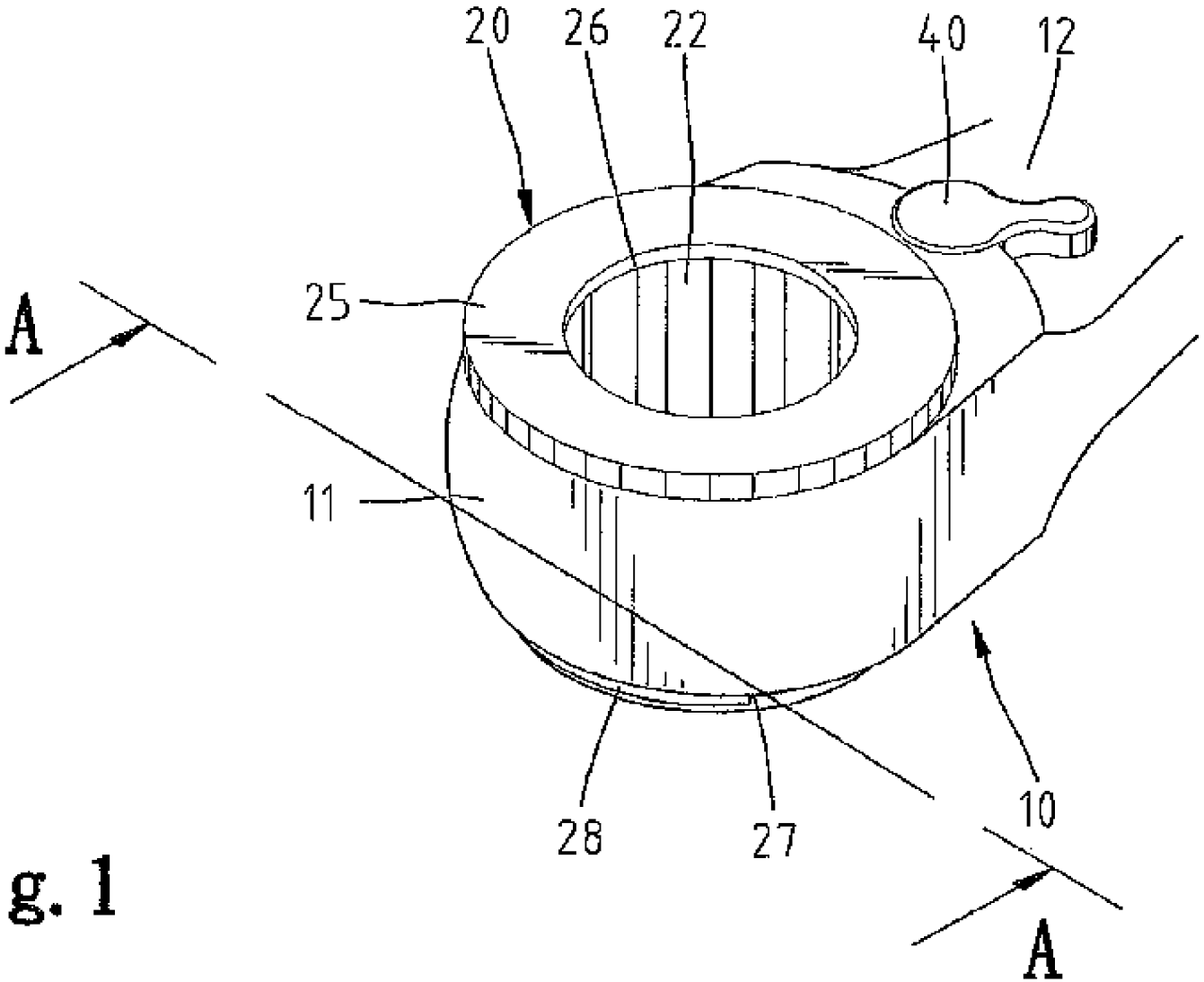
FIG. 1 is a perspective view of a first embodiment of a ratcheting wrench in accordance with the present invention.
Figure 2:
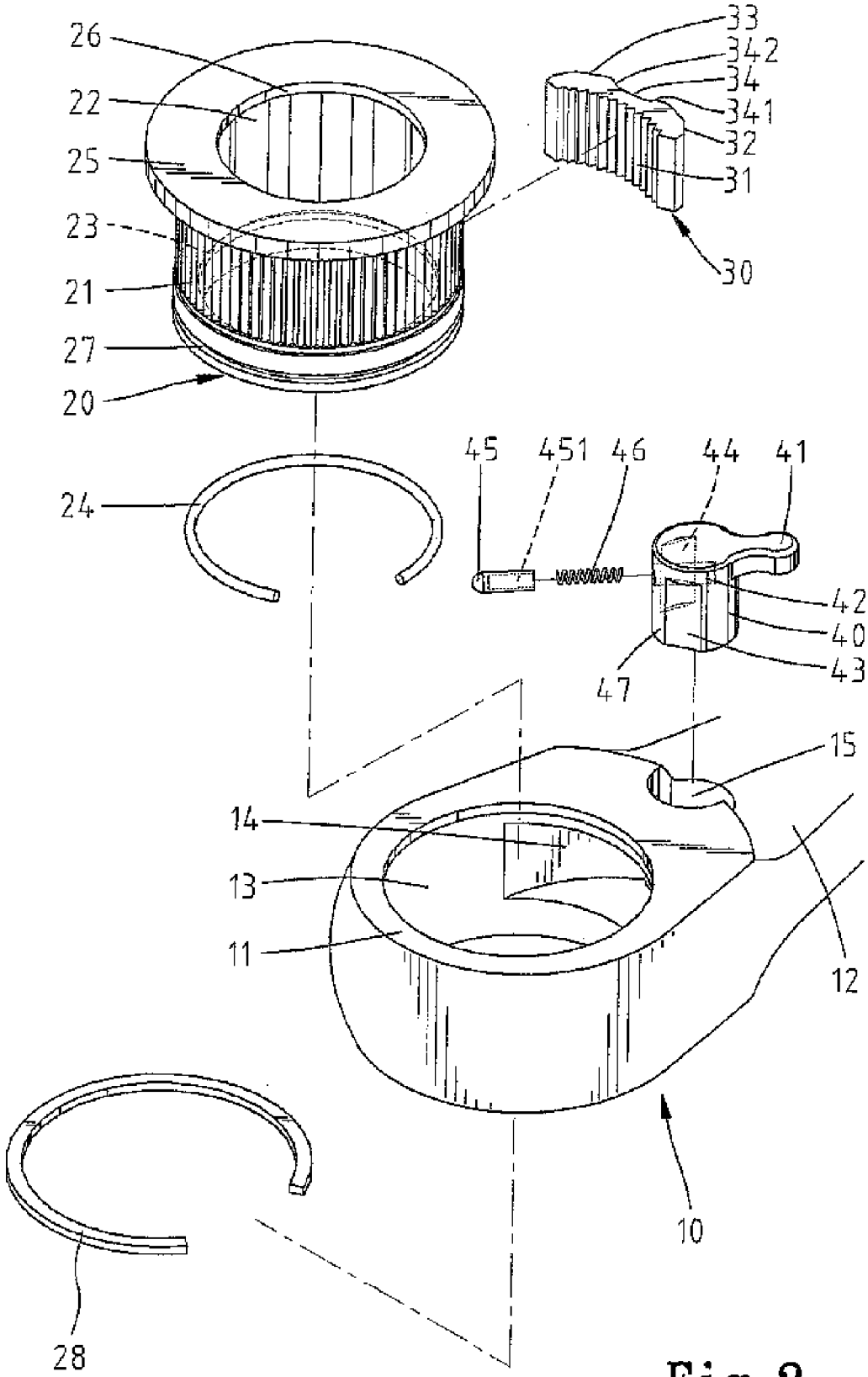
FIG. 2 is an exploded perspective view of the first embodiment of the ratcheting wrench in accordance with the present invention.
Figure 3:
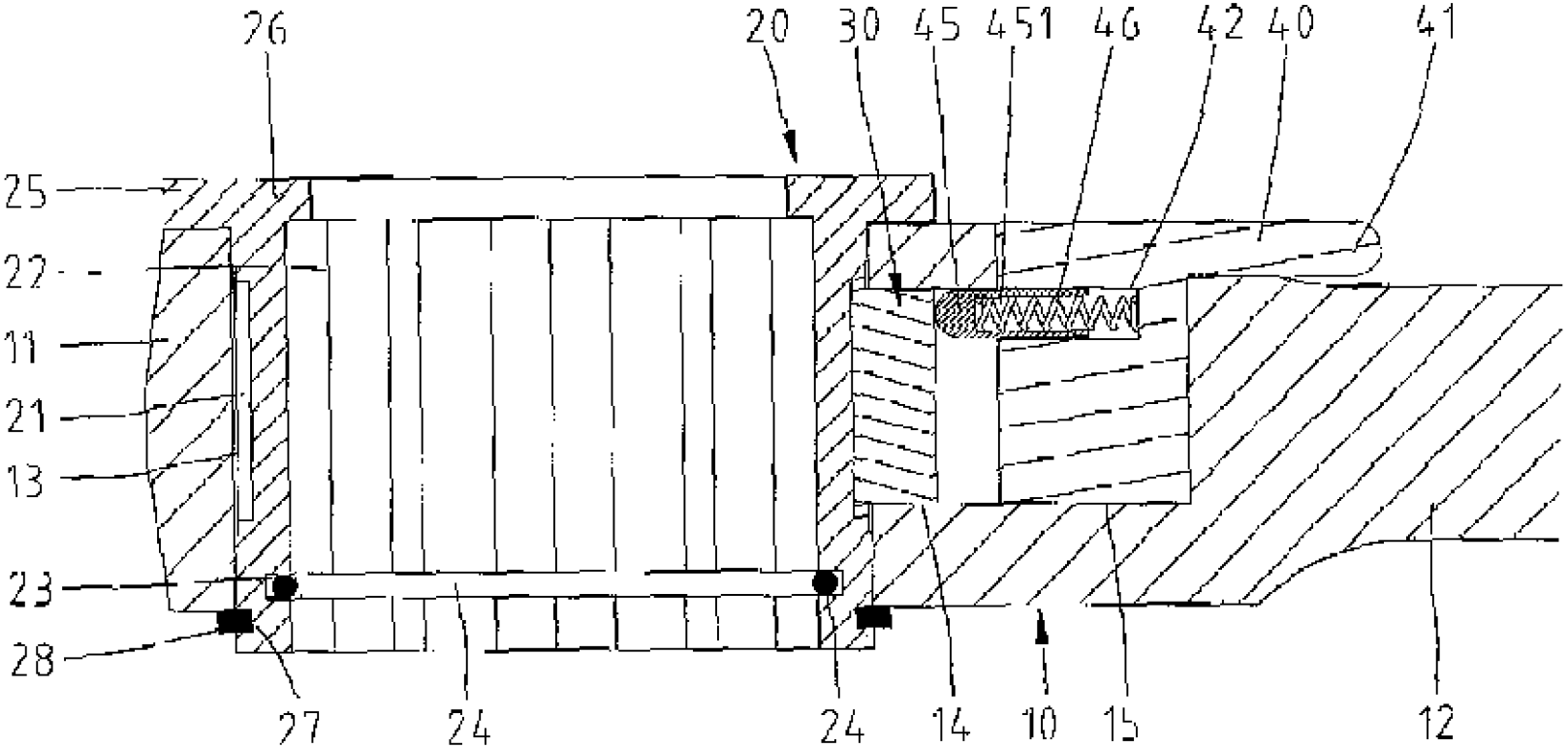
FIG. 3 is a sectional view of the first embodiment of the ratcheting wrench in accordance with the present invention.

Referring to FIGS. 1 through 3, a first embodiment of a ratcheting wrench in accordance with the present invention is designated by 10 and generally comprises a handle 12 and a head 11 extending from an end of the handle 12. The head 11 is in the form of a box end and includes a hole 13. A compartment 14 is defined in the end of the handle 12 and communicated with the hole 13 of the head 11. In an embodiment of the invention, a ratcheting mechanism is provided in the compartment 14 and includes a pawl 30. An opening 15 is defined in a side (upper side in FIG. 2) of the end of the handle 12 and communicated with the compartment 14.

A drive member 20 is rotatably held in the hole 13 of the head 11 and includes a first end and a second end. The drive member 20 includes an inner periphery 22 that functions as an engaging portion for engaging with a fastener-driving member (e.g., a screwdriver 50), and a plurality of teeth 21 are defined in an outer periphery of the drive member 20. An annular groove 23 is defined in the inner periphery 22 of the drive member 20 for receiving a retainer 24, e.g., a C-clip. The first end of the drive member 20 includes an operative portion 25 that is substantially a disc or flange 25 on an end of the outer periphery of the drive member 20. The flange 25 abuts against an end face of the head 11, as shown in FIG. 3. Preferably, the flange 25 has an embossed outer periphery to increase friction, allowing turning of the drive member 20 by grasping and turning the flange 25. Further, still referring to FIG. 3, a stop (e.g., an inner flange 26 integrally formed with drive member 20 as a unitary, unseparable component) projects inwardly from an end of the inner periphery of the drive member 20 and is located in a position preferably beyond the hole 13 of the head 11. Further, the other end of the outer periphery of the drive member 20 extends beyond the head 11. Further, an annular groove 27 is defined in the other end of the outer periphery of the drive member 20, and a retainer 28 such as a C-clip is partially received in the annular groove 27 of the drive member 20 to thereby prevent the drive member 20 from falling out of the hole 13 of the head 11, best shown in FIG. 3. Thus, the drive member 20 is rotatably retained in the hole 13 of the head 11.

The pawl 30 has a plurality of teeth 31 on a side thereof for releasably engaging with the teeth 21 of the drive member 20. A recessed portion 34 is formed on the other side of the pawl 30 and includes two inclined faces 341 and 342 spaced apart by an intermediate section (not labeled) therebetween. The pawl 30 further includes two abutting faces 32 and 33 for abutting against a wall delimiting the compartment 14 of the handle 12 when proceeding ratcheting operation for tightening/loosening a fastener 60.

Figure 3A:
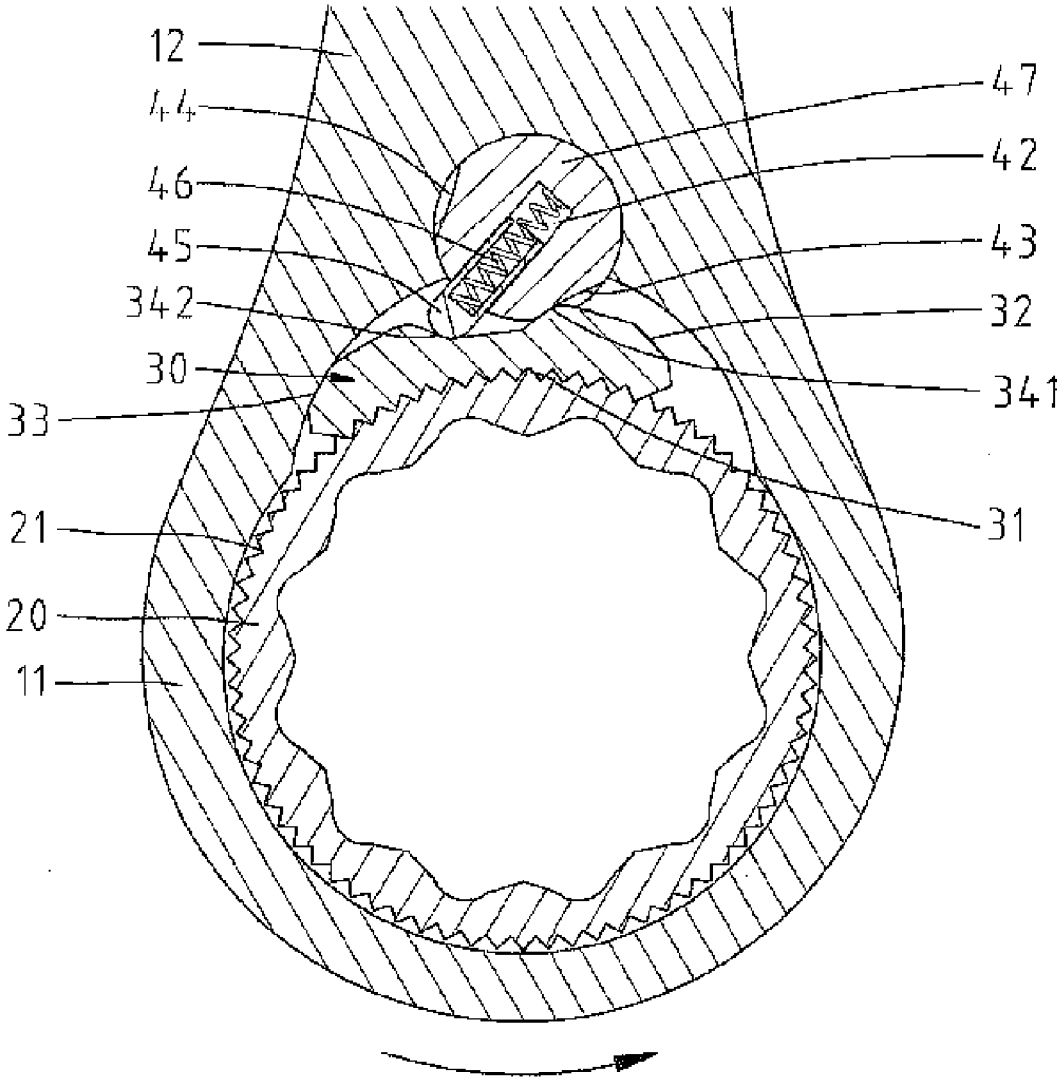
FIG. 3A is a sectional view taken along plane A—A in FIG. 1.

A switch member 40 is provided for controlling position of the pawl 30 in the compartment 14. The switch member 40 includes a substantially cylindrical body 47 that is rotatably received in the compartment 14 and a turn piece 41 that extends outward from an end of the cylindrical body 47 to a position beyond the handle 12 via the opening 15 of the handle 12 for manual operation. The cylindrical body 47 includes a receptacle 42 for receiving an elastic element 46 and a pressing member 45 having a receptacle 451 defined therein. As illustrated in FIG. 3, the pressing member 45 is partially received in the receptacle 42 of the cylindrical body 47, with an end of the elastic element 46 attached to an end wall delimiting the receptacle 42 of the cylindrical body 47 and with the other end of the elastic element 46 attached to an end wall delimiting the receptacle 451 of the pressing member 45. The pressing member 45 is normally biased by the elastic element 46 to press against one of the inclined faces 341 and 342 of the pawl 30 (e.g., the inclined face 342, see FIG. 3A), thereby urging a portion of the teeth 31 of the pawl 30 to engage with the teeth 21 of the drive member 20. In this case, as shown in FIG. 3A, the wrench allows ratcheting operation (i.e., tightening or loosening of a fastener) in the counterclockwise direction and allows free rotation in the clockwise direction (i.e., the fastener is not turned when the handle 12 is turned clockwise). It is noted that the abutting face 33 of the pawl 30 abuts a wall delimiting the compartment 14 of the handle 12 when the drive member 20 is turned in the ratcheting direction.

Figure 3B:
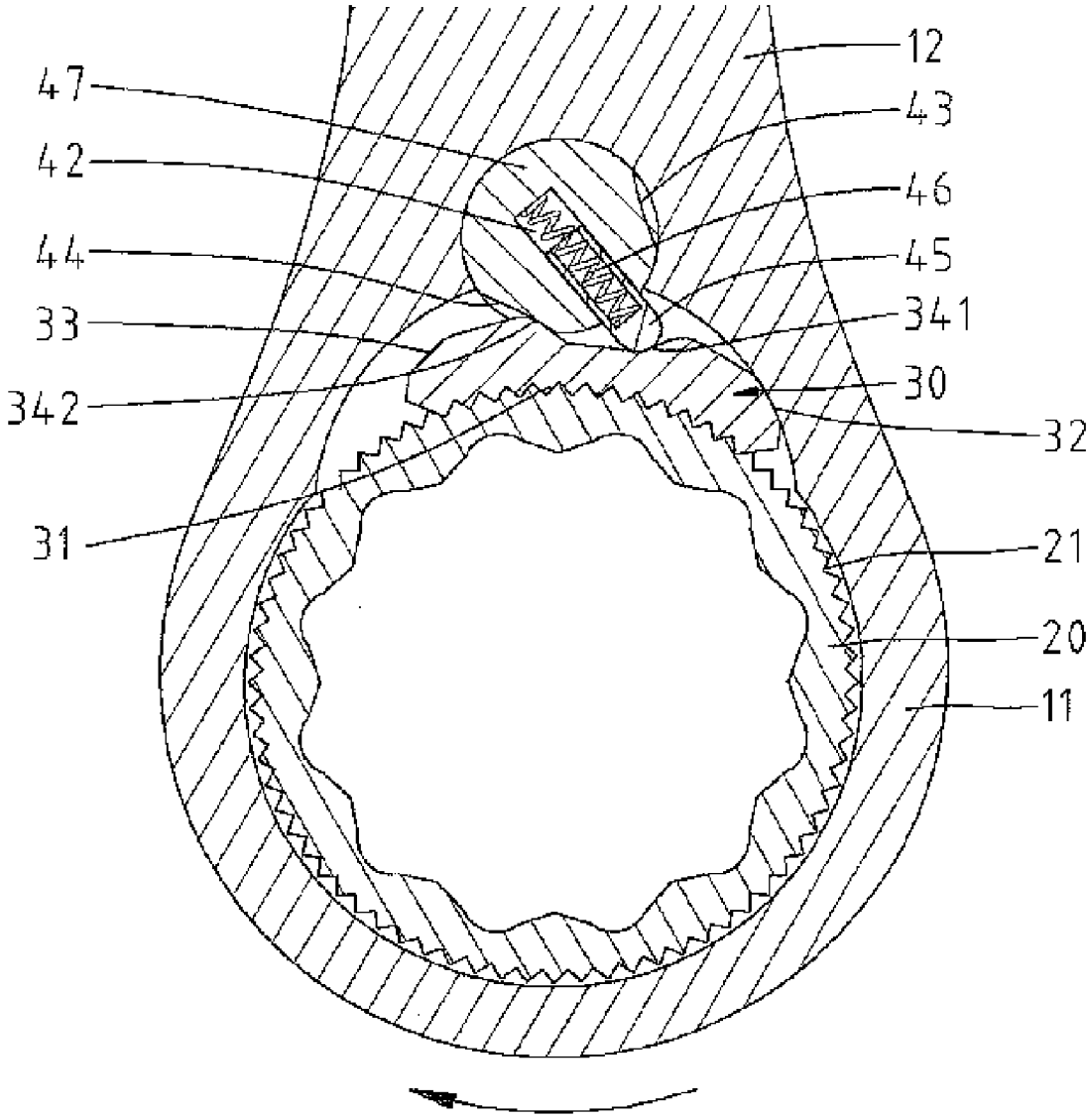
FIG. 3B is a sectional view similar to FIG. 3A, illustrating operation of the ratcheting wrench in a reverse direction.

When the turn piece 41 of the switch member 40 is turned, the pressing member 45 is moved from the inclined face 342 to the other inclined face 341. The other portion of the teeth 31 of the pawl 30 engages with the teeth 21 of the drive member 20. In this case, the wrench allows ratcheting operation in the clockwise direction and allows free rotation in the counterclockwise direction (i.e., the fastener is not turned when the handle 12 is turned counterclockwise). It is noted that the abutting face 32 of the pawl 30 abuts the wall delimiting the compartment 14 of the handle 12 when the drive member 20 is turned in the ratcheting direction. The cylindrical body 47 further includes two engaging faces or portions 43 and 44 one of which presses against an associated one of the inclined faces 341 and 342 of the pawl 30, as shown in FIGS. 3A and 3B. This provides a more reliable support for the pawl 30.

Figure 4:
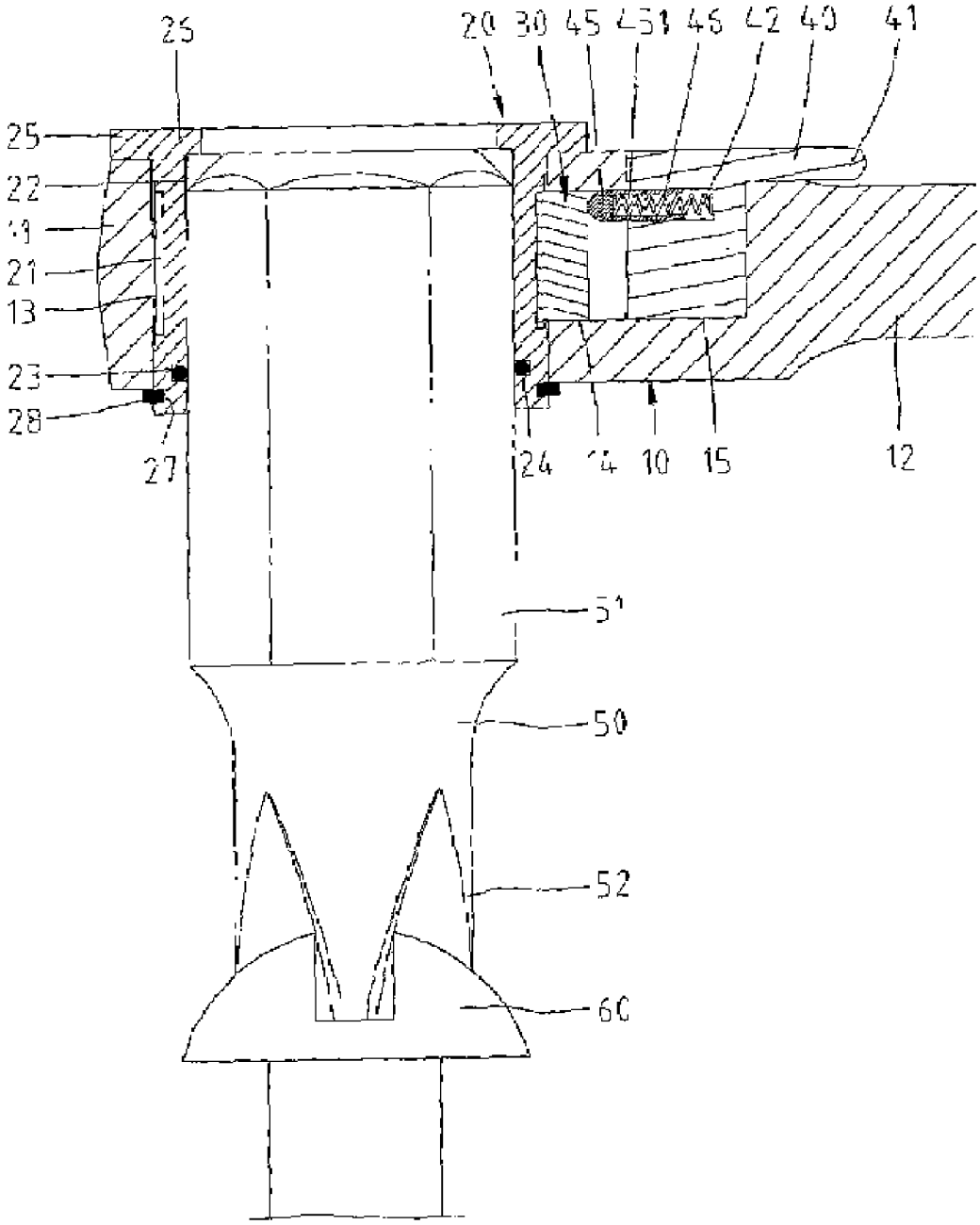
FIG. 4 is a sectional view similar to FIG. 3, illustrating use of the first embodiment of the ratcheting wrench in accordance with the present invention.
Figure 5:
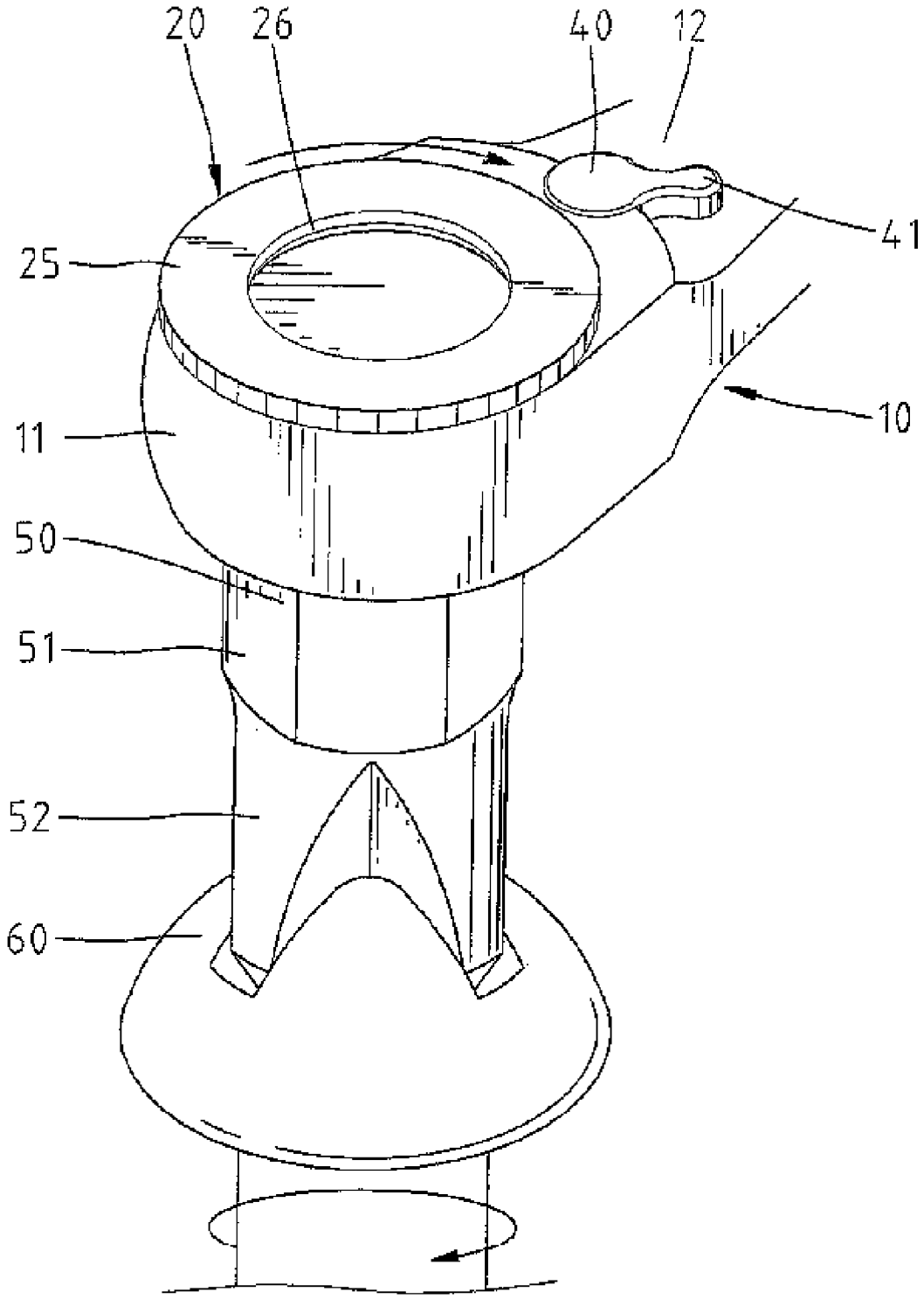
FIG. 5 is a perspective view illustrating quick tightening operation of the first embodiment of the ratcheting wrench in accordance with the present invention.

Referring to FIG. 4, in use, a portion of a fastener-driving tool, e.g., a shank 51 of a screwdriver 50 is inserted into the drive member 20 until an end face of the shank 51 is stopped by the inner flange 26 (i.e., the stop). The shank 51 of the screwdriver 50 is retained in the inner periphery 22 functioning as an engaging portion of the drive member 20 by the retainer 24. When tightening a fastener 60, referring to FIG. 5, the user may grasp and turn the flange 25 rapidly, which causes rapid rotation of the drive member 20 and the shank 51 of the screwdriver 50. Thus, the fastener 60 is quickly turned in the tightening direction until a relatively large force is required for securely tightening the fastener 60. This is because the force required for turning the drive member 20 is smaller at the first stage of tightening the fastener 60. Another reason allowing rapid turning of the drive member 20 is that the flange 25 has an outer diameter that is much smaller when compared to the arm of force for turning the handle 12. Thus, the time for turning the fastener 60 to an almost tightened position is much shorter when compared to the use of the handle 12, as the angular travel of the drive member 20 is much shorter than that of the handle 12.

Figure 6:
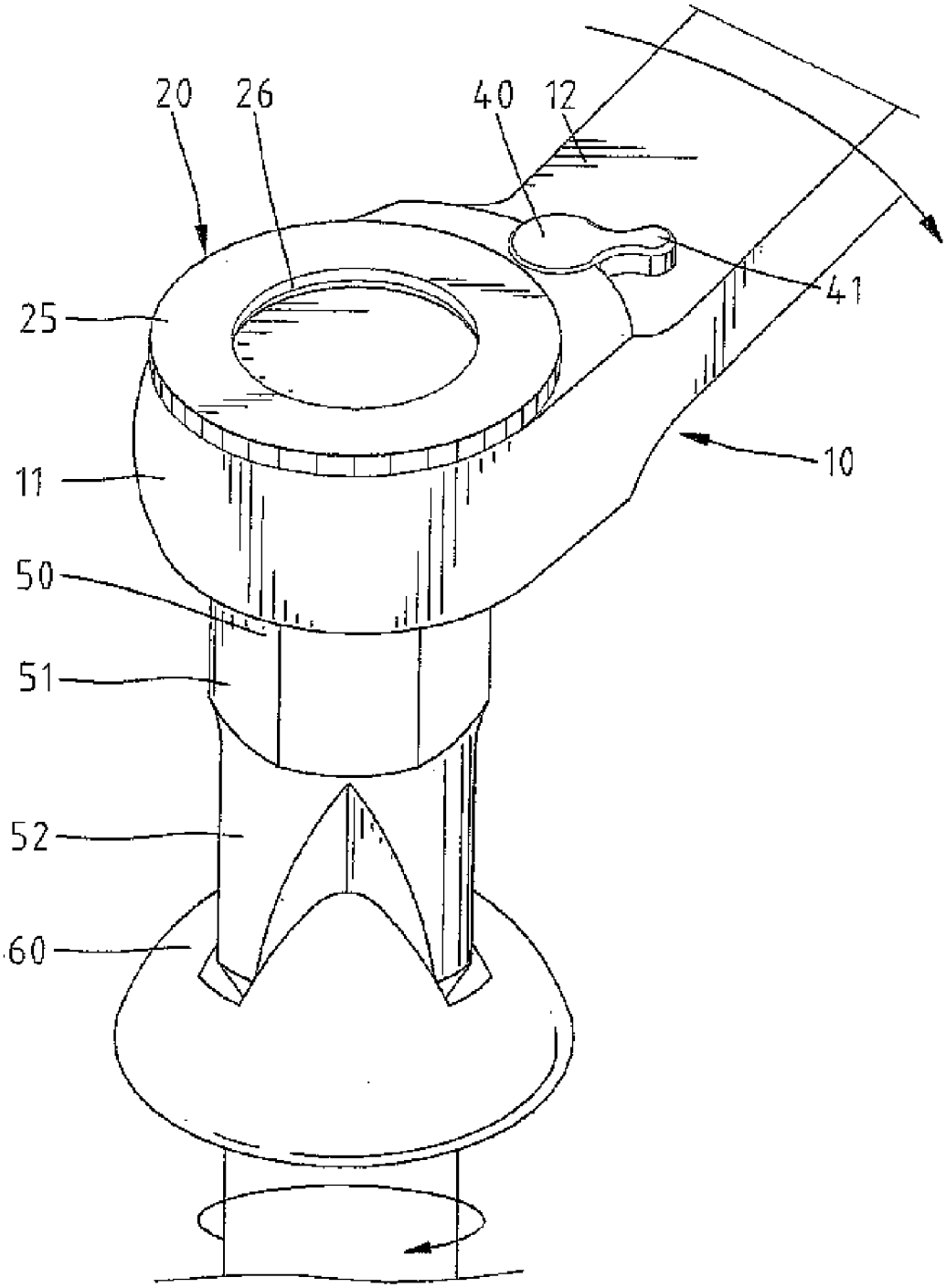
FIG. 6 is a perspective view illustrating final tightening operation procedure of the first embodiment of the ratcheting wrench in accordance with the present invention.

Referring to FIG. 6, when the fastener 60 is turned to the almost tightened position, the user may use the handle 12 to proceed with firm, reliable tightening of the fastener 60, as the arm of force is greater. Thus, the fastener 60 can be tightened in a rapid and reliable manner. Of course, the time for loosening the fastener 60 can be shortened. It can be achieved by firstly loosening the fastener 60 by turning the handle 12 to a slightly loosened position and then loosening the fastener 60 by turning the flange 25 of the drive member 20 with the fingers of the user. Further, the user may manually turn the flange 25 of the drive member 20 through a relatively small angle to thereby finely adjust the angular position of the drive member 20 and the shank 51 of the screwdriver 50. In particular, when desired, the drive member 20 can be turned relative to the pawl 30 in a "tooth-by-tooth" manner; namely, the drive member 20 passes through only one of the teeth 31 of the pawl 30. This allows the user to finely adjust the tightening force for the fastener 60.

Figure 7:
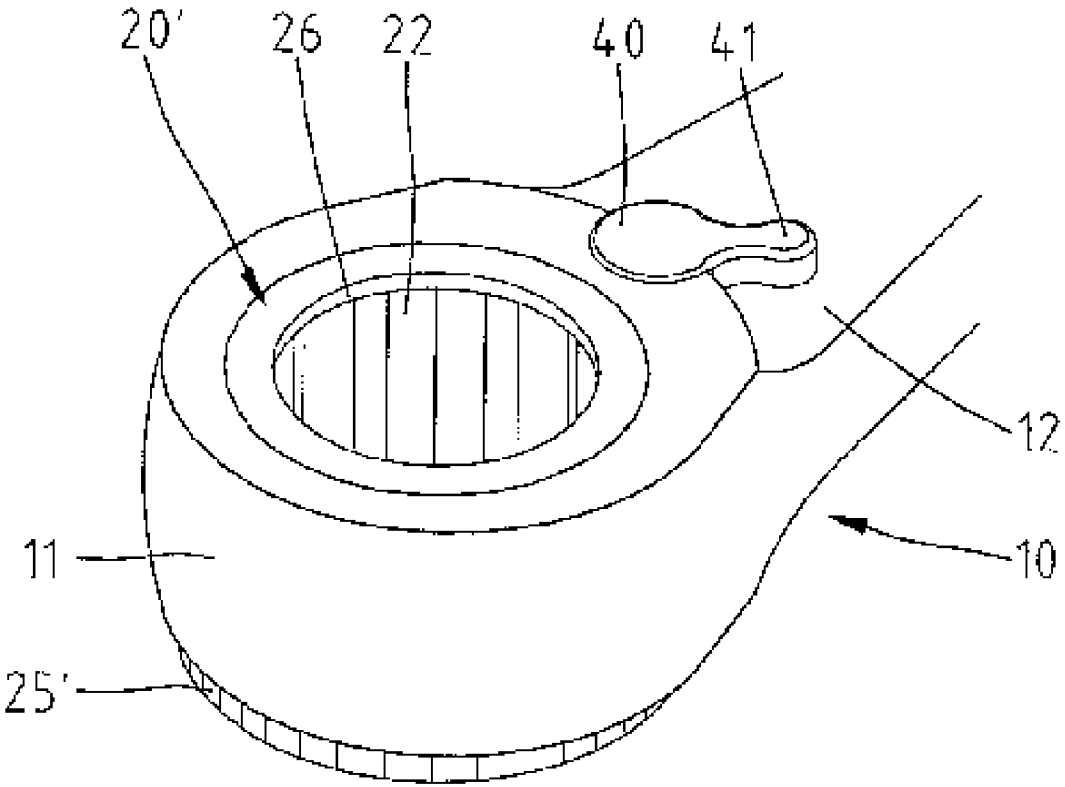
FIG. 7 is a perspective view of a second embodiment of the ratcheting wrench in accordance with the present invention.
Figure 8:
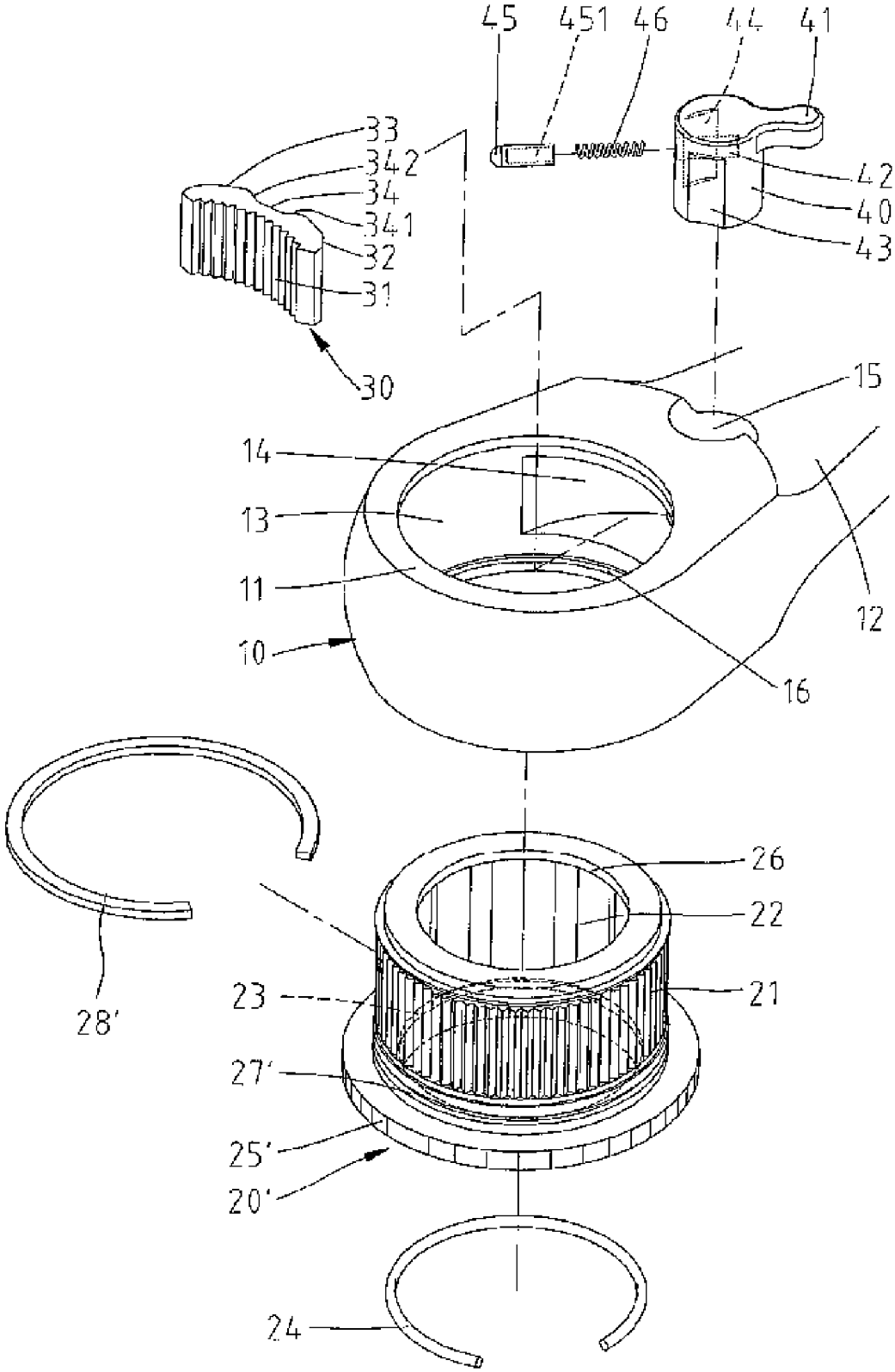
FIG. 8 is an exploded perspective view of the second embodiment of the ratcheting wrench in accordance with the present invention.
Figure 9:
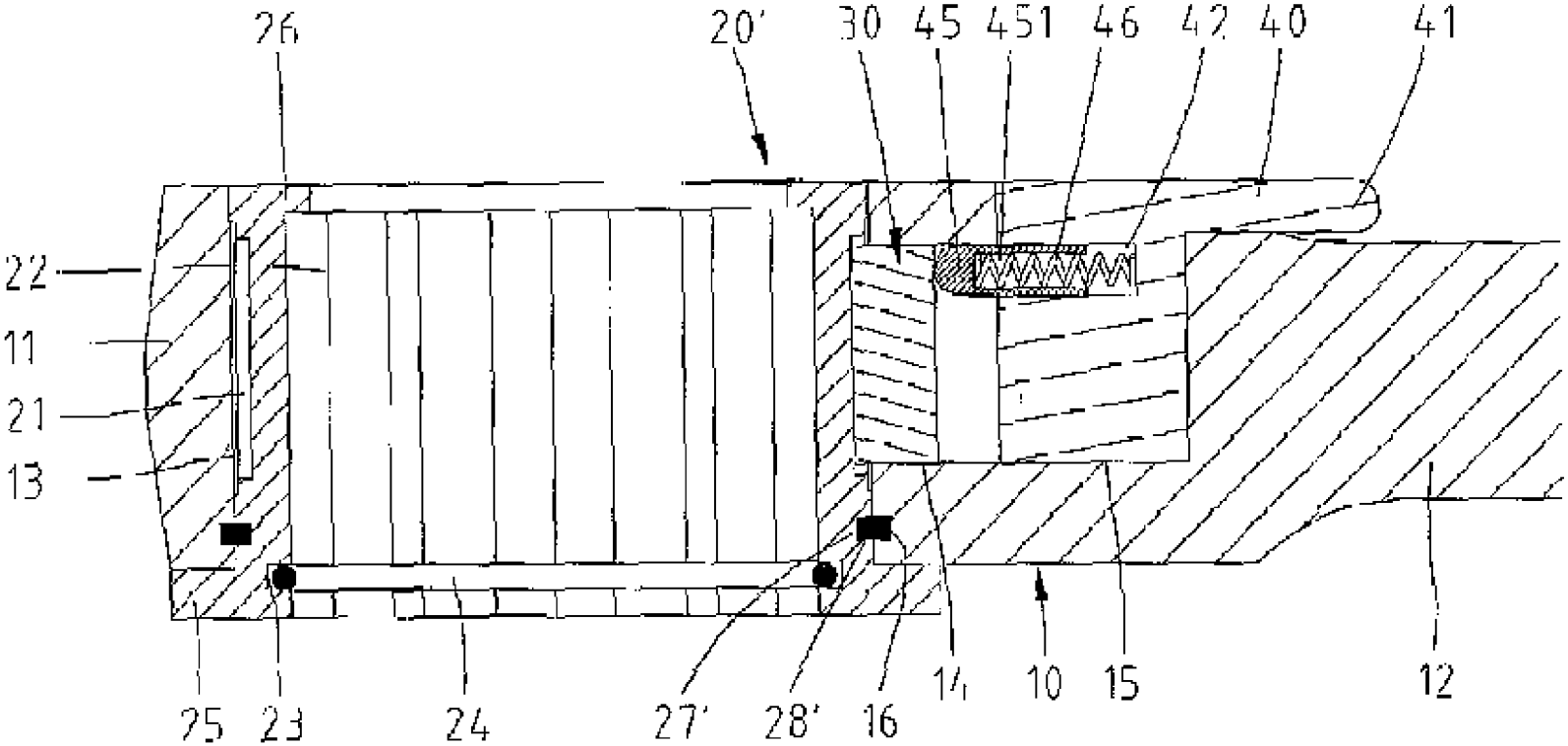
FIG. 9 is a sectional view of the second embodiment of the ratcheting wrench in accordance with the present invention.

FIGS. 7 through 9 illustrate a second embodiment of the ratcheting wrench in accordance with the present invention, wherein like reference numerals designate like elements. In this embodiment, an annular groove 16 is defined in the inner periphery delimiting the hole 13 of the head 11, and a retainer 28', e.g., a C-clip is partially received in the annular groove 16 of the hole 13 and partially received in the annular groove (now designated by 27') of the drive member 20'. Further, the flange (now designated by 25') of the drive member 20' is formed on the other end of the drive member 20'. It is noted that the drive member 20' has an upper end that is flush with the upper end face of the head 11. Operation of the wrench of FIGS. 7 through 9 is substantially the same as that of the wrench of FIGS. 1 through 6.

Figure 10:
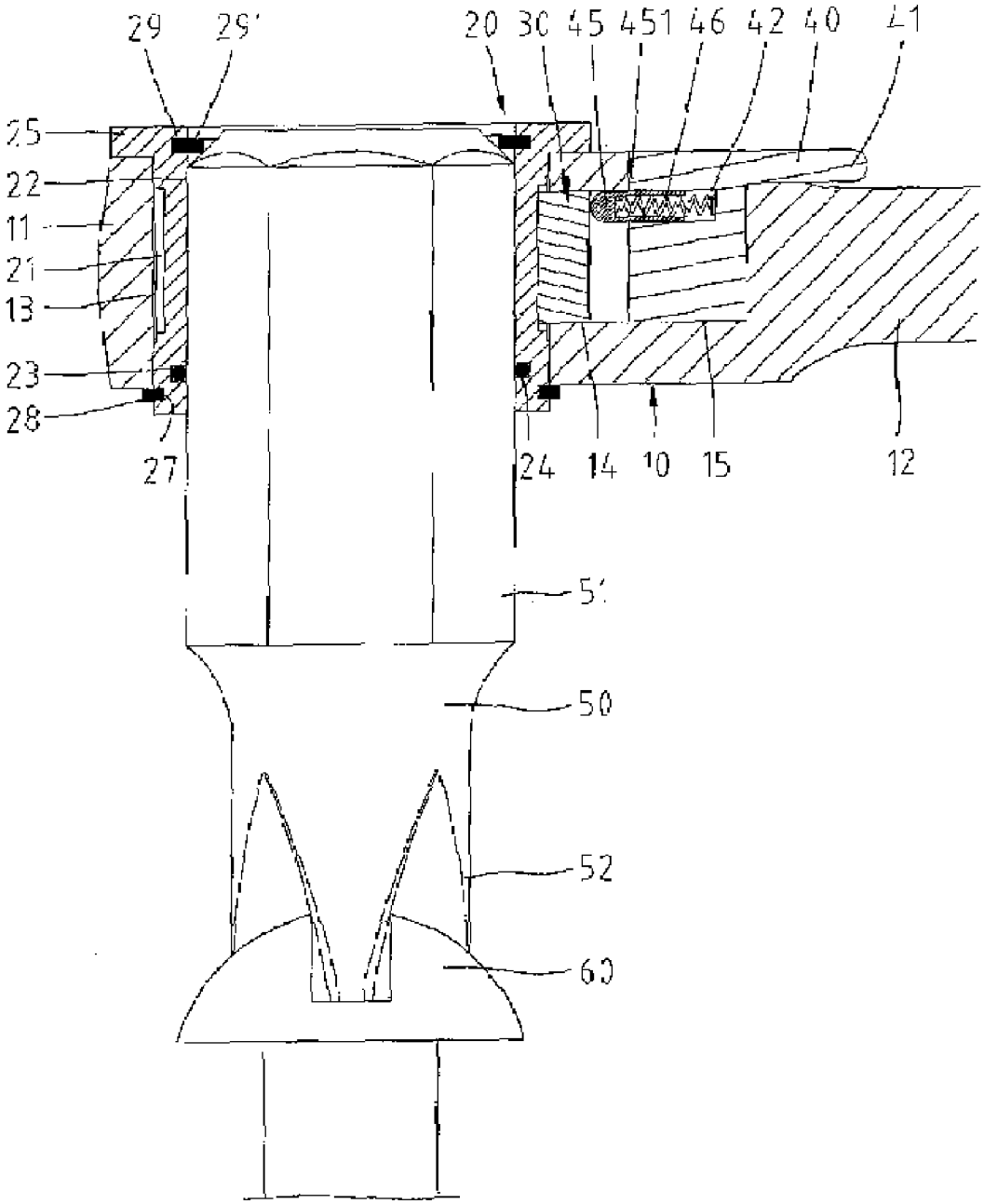
FIG. 10 is a sectional view similar to FIG. 4, illustrating a third embodiment of the ratcheting wrench in accordance with the present invention.

FIG. 10 illustrates a third embodiment of the ratcheting wrench in accordance with the present invention, wherein like reference numerals designate like elements. Compared to the first embodiment (particularly FIG. 3), the flange 26 of the first embodiment is replaced with an annular groove 29 in the inner periphery 22 of the drive member 20, and a retainer 29', such as a C-clip is partially received in the annular groove 29. Namely, the retainer 29' extends inward from the inner periphery 22 of the drive member 20 to act as a stop for preventing the shank 51 of the screwdriver 50 from falling out of the drive member 20 via the end (the upper one in FIG. 10) of the drive member 20.

Preferably, the flange 25, 25' protrudes in a radial direction of the head 11 to a position beyond an end face of the head 11, allowing easy grasp and turning of the drive member 20'.

Figure 11:
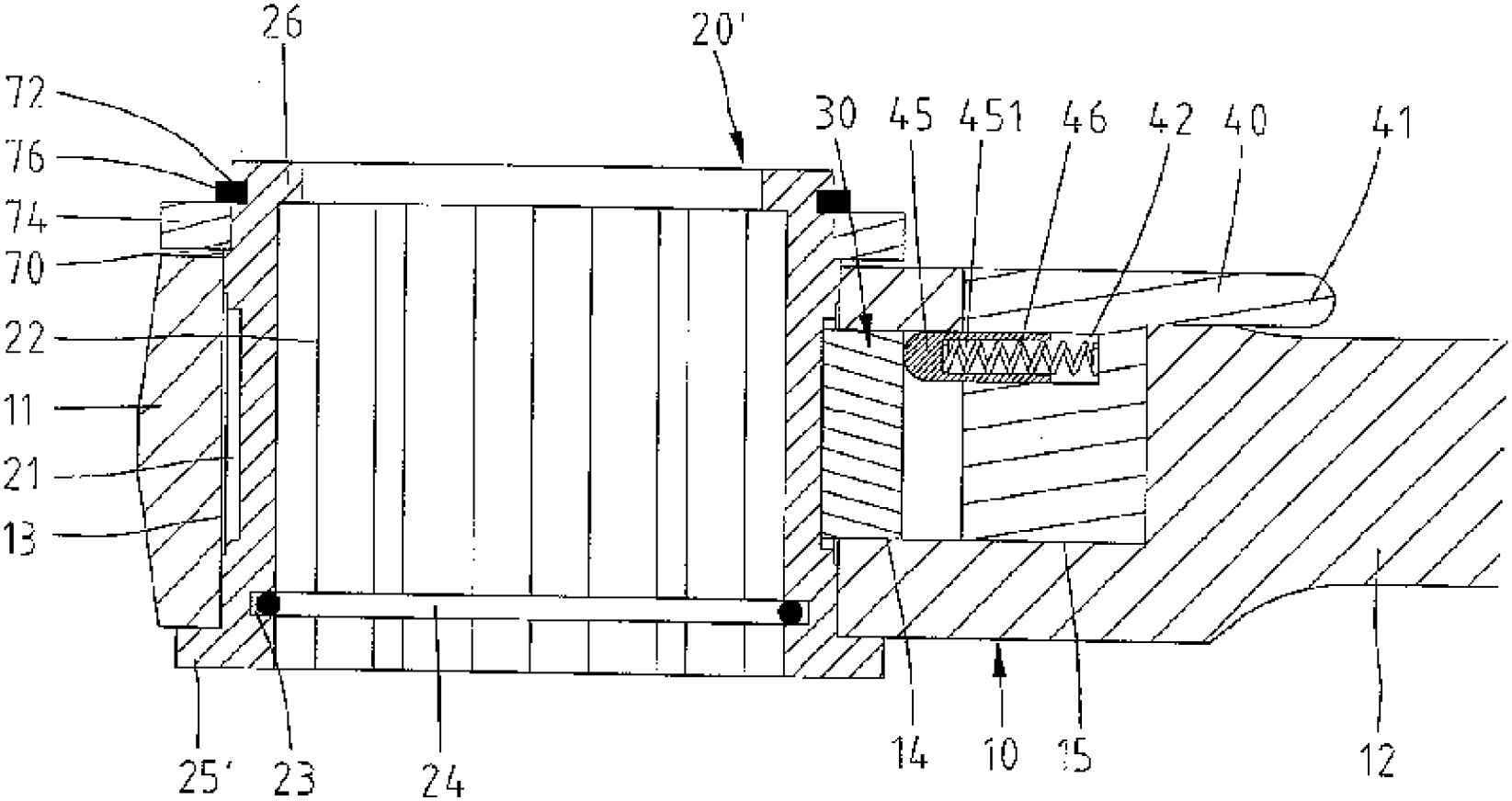
FIG. 11 is a sectional view similar to FIG. 9, illustrating a fourth embodiment of the ratcheting wrench in accordance with the present invention.

FIG. 11 illustrates a fourth embodiment that is modified from the second embodiment of the ratcheting wrench in accordance with the present invention, wherein like reference numerals designate like elements. In this embodiment, the lower end and the upper end of the drive member 20' are located outside the head 11. In addition to the flange 25' formed on the lower end of the outer periphery of the drive member 20', the upper end of the outer periphery of the drive member 20' includes a shoulder 70. Further, an annular groove 72 is defined in the upper end of the outer periphery of the drive member 20' in a position above the shoulder 70. A ring 74 is mounted around the upper end of the outer periphery of the drive member 20' and has a side abutting against the shoulder 70. A retainer 76 is partially received in the annular groove 72, with the exposed portion of the retainer 72 abutting against the other side of the ring 74. Thus, the ring 74 is retained in place and acts as a member allowing the user to grasp for performing quick tightening/loosening functions and minor adjusting functions mentioned above.

Figure 12:
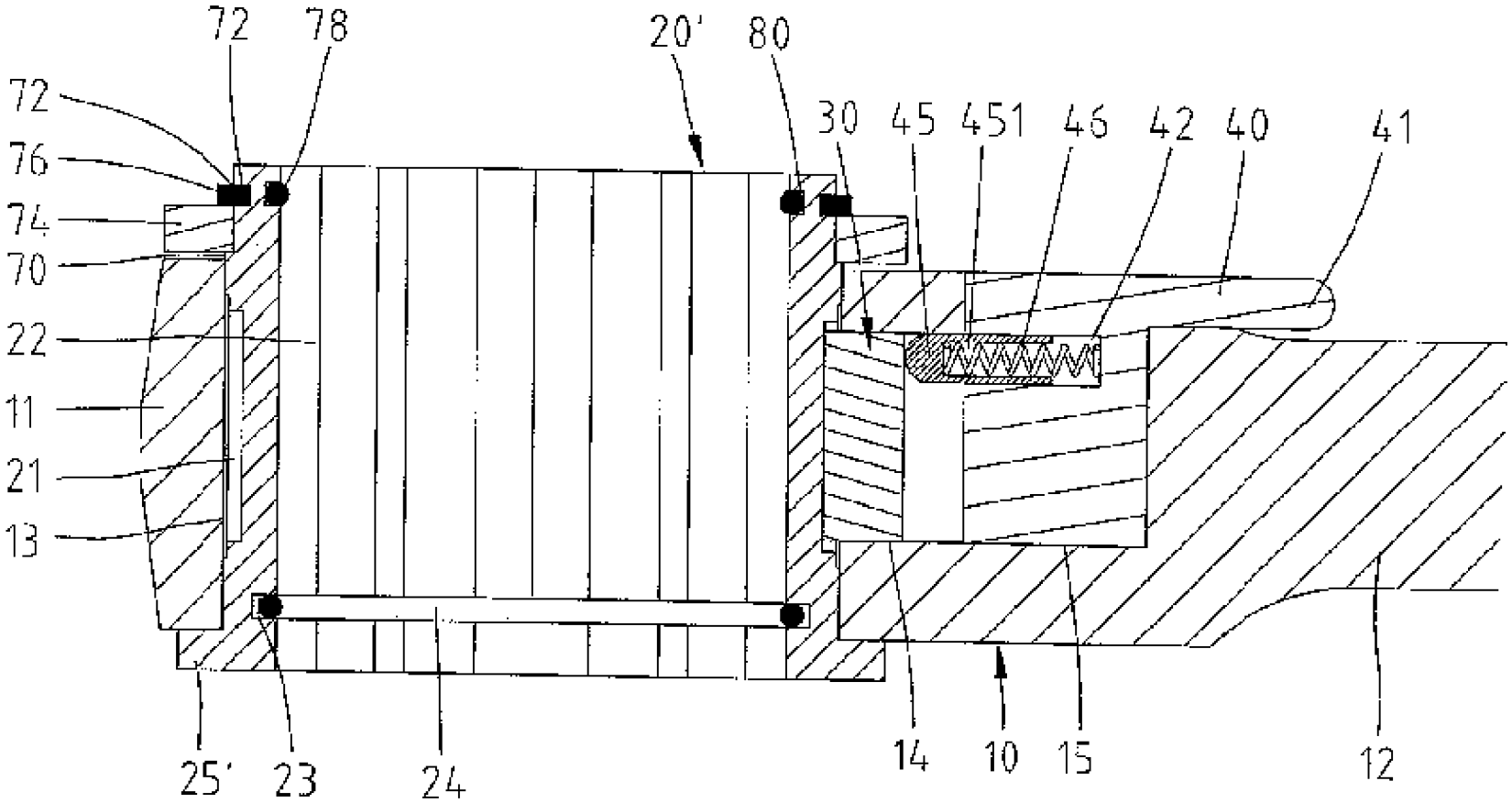
FIG. 12 is a sectional view similar to FIG. 11, illustrating a fifth embodiment of the ratcheting wrench in accordance with the present invention.

FIG. 12 illustrates a fifth embodiment of the invention that is modified from the fourth embodiment, wherein the flange 26 of the fourth embodiment is replaced with an annular groove 80 in the inner periphery 22 of the drive member 20', and a retainer 78, such as a C-clip is partially received in the annular groove 80. Namely, the retainer 78 extends inward from the inner periphery 22 of the drive member 20' to act as a stop for preventing the shank 51 of the screwdriver 50 from falling out of the drive member 20' via the upper end of the drive member 20' (c.f. FIG. 10).

Figure 13:
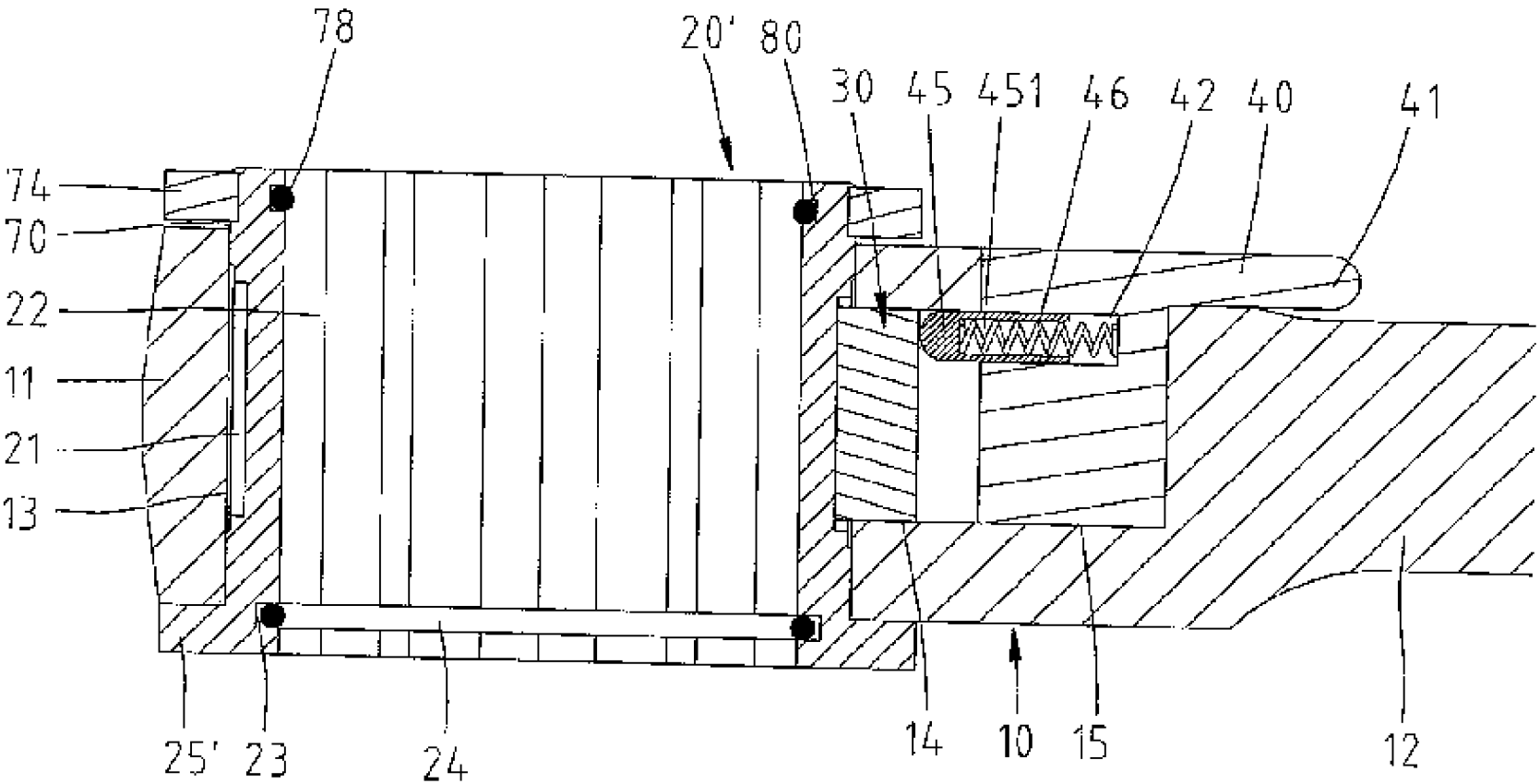
FIG. 13 is a sectional view similar to FIG. 12, illustrating a sixth embodiment of the ratcheting wrench in accordance with the present invention.

FIG. 13 illustrates a sixth embodiment that is modified from the fifth embodiment of the ratcheting wrench in accordance with the present invention, wherein like reference numerals designate like elements. In this embodiment, the annular groove 72 and the retainer 76 are omitted. Further, the ring 74 is fixed in place by riveting.

Figure 14:
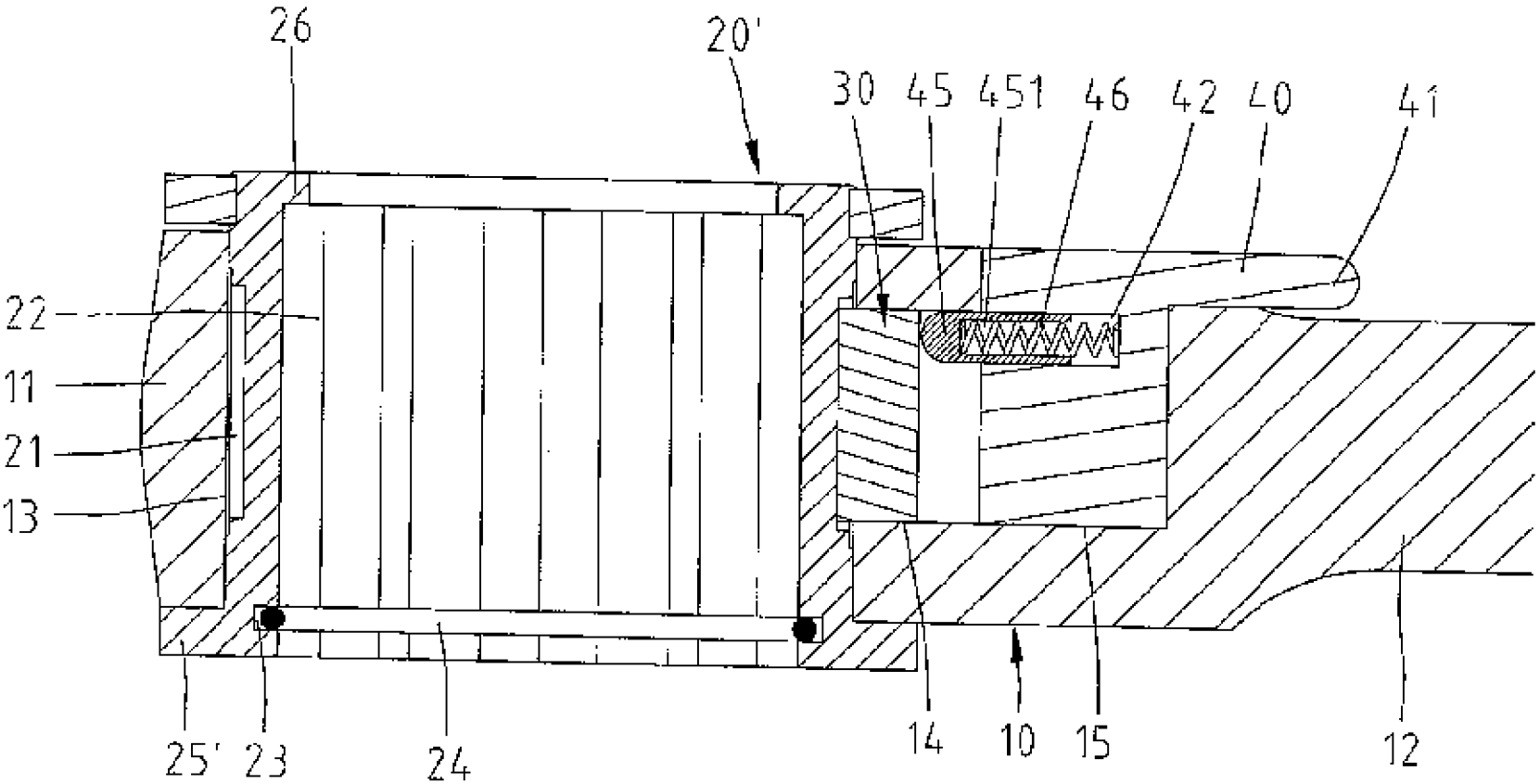
FIG. 14 is a sectional view similar to FIG. 13, illustrating an seventh embodiment of the ratcheting wrench in accordance with the present invention.
Figure 15:
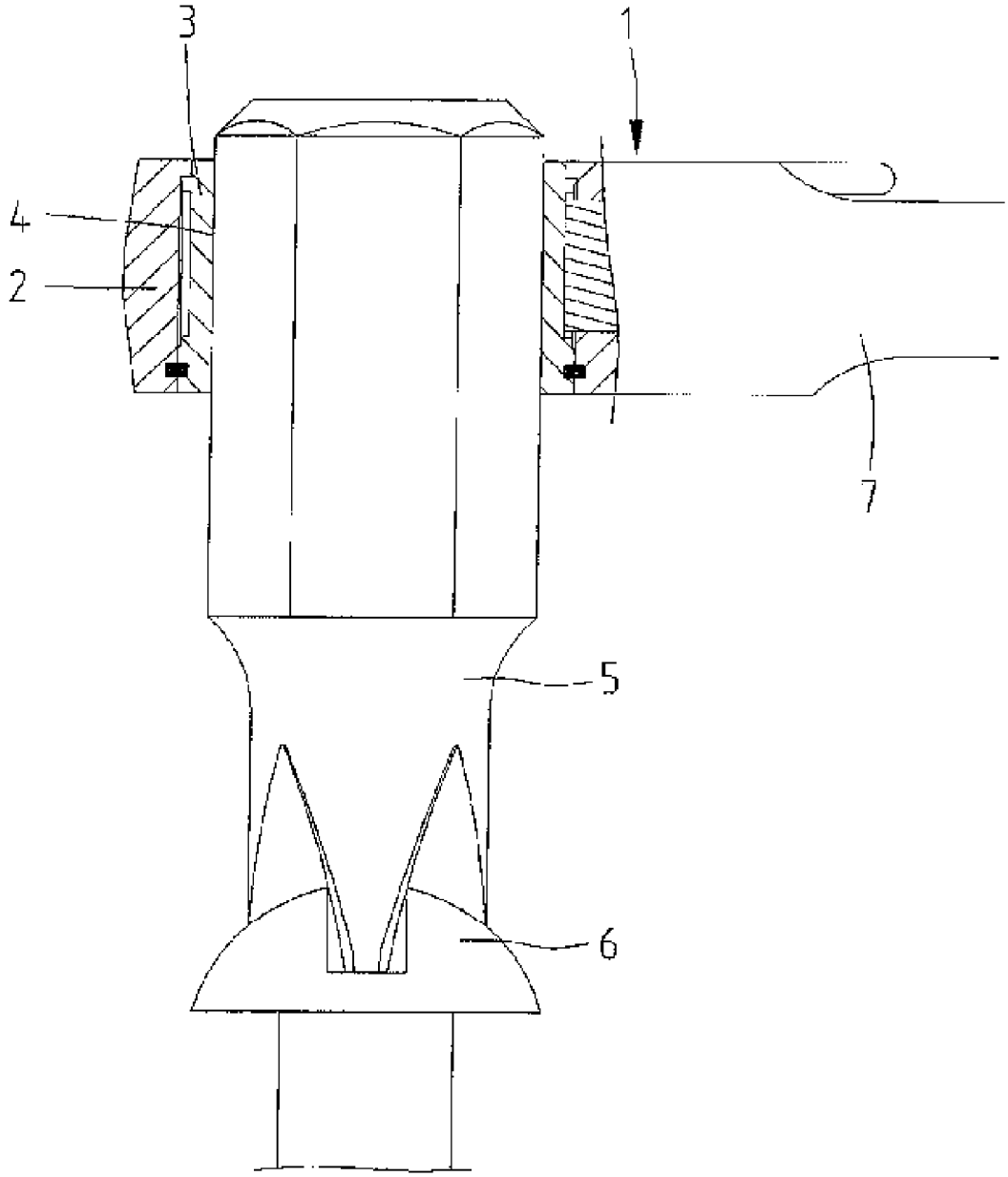
Fig. 15 PRIOR ART
FIG. 15 is a schematic side view, partly sectioned, of a conventional ratcheting wrench.

FIG. 14 illustrates a seventh embodiment that is modified from the fourth embodiment of the ratcheting wrench in accordance with the present invention, wherein like reference numerals designate like elements. In this embodiment, the annular groove 72 and the retainer 76 are omitted. Further, the ring 74 is fixed in place by riveting.

The ratcheting wrenches of FIGS. 11 through 14 allow easy manufacture and assembly, as neither the inner periphery of the hole 13 of the head 11 nor the outer periphery of the drive member 20, 20' is required to form an annular groove. The manufacturing cost is thus reduced.

It is noted that the ratcheting mechanism and the switch member 40 are not limited to those disclosed herein and shown in the accompanying drawings. They can be replaced with any other structures allowing reversible or irreversible ratcheting operation. The "fastener-driving member" as used herein is not limited to the whole tool. Namely, the "fastener-driving member" may be a whole screwdriver or the like, a screwdriver shank 51 with a bit 52, or a screwdriver bit. Of course, another member that serves the function of driving fasteners can be used as the fastener-driving member without departing from the scope of the invention.

According to the above description, it is appreciated that the drive member 20, 20' of the ratcheting wrench in accordance with the present invention can be turned quickly such that the time for tightening/loosening a fastener can be significantly reduced. Further, the tightening force for the fastener can be finely adjusted. These advantages are provided by the flange 25, 25' on an end of the drive member 20, 20'. Further, the fastener-driving member 50 is securely retained in place by the retainer 24, and the fastener-driving member is prevented from disengaging from the drive member 20, 20' by a stop (i.e., the retainer 29' in FIG. 10 or the inner flange 26 in FIG. 3). Further, manufacture and assembly of the ratcheting wrench in accordance with the present invention can be simplified when the designs of FIGS. 11 through 14 are adopted.

Although the invention has been explained in relation to its preferred embodiment, it is to be understood that many other possible modifications and variations can be made without departing from the scope of the invention as hereinafter claimed.

What is claimed is:

1. A ratcheting wrench comprising:

a handle having an end, the end of the handle having a compartment;

a head extending from the end of the handle and having a hole communicated with the compartment of the handle;

a drive member rotatably mounted in the hole of the head, the drive member formed as a unitary, unseparable component including a first end, a second end, an inner periphery and an outer periphery, with the inner and outer peripheries extending between the first and second ends, with the inner periphery adapted to securely, releasably hold a fastener-driving member, allowing joint rotation of the fastener-driving member and the drive member when the drive member is turned, the drive member further including a plurality of teeth on the outer periphery thereof;

a ratcheting mechanism mounted in the compartment of the handle and engaged with the teeth of the drive member;

an annular groove being defined in the inner periphery of the drive member;

a fastener retainer being received in the annular groove for releasably holding the fastener-driving member in place;

the drive member further including a flange at one of the first and second ends of the outer periphery and located outside the head for manual rotation of the drive member; and a drive retainer removably retained on the outer periphery of the drive member, with the flange and the drive retainer preventing the drive member from falling out of the hole of the head.

2. The ratcheting wrench as claimed in claim 1, wherein the flange is integrally formed as a unitary, unseparable component with the outer periphery of the drive member.

3. The ratcheting wrench as claimed in claim 2, wherein the drive member further includes a stop for preventing the fastener-driving member from disengaging from the drive member through the first end of the inner periphery of the drive member.

4. The ratcheting wrench as claimed in claim 3 wherein the stop is an inner flange integrally formed on the inner periphery of the drive member as a unitary, unseparable component.

5. The ratcheting wrench as claimed in claim 3 wherein the stop is an annular groove defined in the inner periphery of the drive member, a retainer being partially received in the annular groove for preventing the fastener-driving member from disengaging from the drive member through the first end of the inner periphery of the drive member.

6. The ratcheting wrench as claimed in claim 3 wherein the drive member has a shoulder on the outer periphery and located outside of the head, with the drive retainer being a ring fixedly mounted around said outer periphery of the drive member and abutting against the shoulder, the stop being located on the inner periphery of the drive member and distal to the flange.

7. The ratcheting wrench as claimed in claim 6 wherein the drive member has an annular groove in the outer periphery thereof, with the drive retainer further including a snap retainer partially received in the annular groove of the drive member and abutting against the ring, thereby sandwiching the ring between the snap retainer and the shoulder.

8. The ratcheting wrench as claimed in claim 7, wherein the stop is an inner flange integrally formed on the end of the inner periphery of the drive member as a unitary, unseparable component.

9. The ratcheting wrench as claimed in claim 2 wherein the flange has an embossed outer periphery for easy grasping.

10. The ratcheting wrench as claimed in claim 2 wherein the flange abuts against an end face of the head.

11. The ratcheting wrench as claimed in claim 2 wherein the flange protrudes in a radial direction of the head to a position beyond an end face of the head.

12. The ratcheting wrench as claimed in claim 2 wherein the flange is integrally formed at the first end of the outer periphery, with an annular groove being defined in the second end of the outer periphery of the drive member, with the annular groove extending continuously around the entire outer periphery of the drive member and located outside of the head, and with the drive retainer being partially received in the annular groove of the drive member to thereby prevent the drive member from falling out of the hole of the head.

13. The ratcheting wrench as claimed in claim 2, wherein the first or second end of the drive member opposite to the flange is flush with an end face of the head.

14. The ratcheting wrench as claimed in claim 2, wherein the ratcheting mechanism allows the handle to selectively move in a ratcheting direction for tightening/loosening a fastener engaged with the fastener-driving member and in a free turning direction reverse to the ratcheting direction in which the fastener engaged with the fastener-driving member is not turned.

15. The ratcheting wrench as claimed in claim 14, wherein the end of the handle has an opening defined in a side thereof and communicated with the compartment of the handle, the ratcheting mechanism including a pawl slidably mounted in the compartment of the handle and a switch member rotatably mounted in the compartment of the handle and operably connected to the pawl such that rotation of the switch member causes sliding movement of the pawl in the compartment between two positions, the switch member having a turn piece extending to a position outside the handle via the opening of the handle, allowing manual rotation of the switch member to thereby move the pawl between the two positions for changing the ratcheting direction of the handle.

16. The ratcheting wrench as claimed in claim 15, wherein the pawl includes a first, toothed side for engaging with the teeth of the drive member, the pawl further including a second side having a recessed portion, the recessed portion having two inclined faces that are spaced apart by an intermediate section therebetween, the pawl further including two abutting faces for selectively abutting against a wall delimiting the compartment of the handle when the drive member is turned in the ratcheting direction.

17. The ratcheting wrench as claimed in claim 16 wherein the switch member includes a cylindrical body with the turn piece extending outward from an end of the cylindrical body, a receptacle being defined in the cylindrical body, an elastic element and a pressing member being received in the receptacle of the cylindrical body, the pressing member being biased by the elastic element to selectively press against one of the inclined faces of the pawl.

18. The ratcheting wrench as claimed in claim 17 wherein the cylindrical body further includes two engaging portions one of which presses against an associated one of the inclined faces of the pawl to thereby provide a more reliable support for the pawl when the drive member is turned in the ratcheting direction.

19. The ratcheting wrench as claimed in claim 2, wherein the head has an annular groove in an inner periphery delimiting the hole, the drive member having an annular groove defined in the outer periphery thereof, with the drive retainer being partially received in the annular groove of the head and partially received in the annular groove of the drive member, thereby rotatably holding the drive member in the hole of the head.

20. A ratcheting wrench comprising:

a handle having an end, the end of the handle having a compartment;

a head extending from the end of the handle and having a hole communicated with the compartment of the handle;

a fastener-driving member adapted to drive a fastener;

a drive member rotatably mounted in the hole of the head, the drive member formed as a unitary, unseparable component including a first end, a second end, an inner periphery and an outer periphery, with the inner and outer peripheries extending between the first and second ends, with the inner periphery securely, releasably holding the fastener-driving member, allowing joint rotation of the fastener-driving member and the drive member when the drive member is turned, the drive member further including a flange at one of the first and second ends of the outer periphery thereof and located outside the head for manual rotation of the drive member, the drive member further including a plurality of teeth on the outer periphery thereof;

a ratcheting mechanism mounted in the compartment of the handle and engaged with the teeth of the drive member;

an annular groove being defined in the inner periphery of the drive member;

a fastener retainer being received in the annular groove for releasably holding the fastener-driving member in place; and a drive retainer removably retained on the outer periphery of the drive member, with the flange and the drive retainer preventing the drive member from falling out of the hole of the head.

21. The ratcheting wrench as claimed in claim 20 wherein the drive member includes a stop for preventing the fastener-driving member from disengaging from the drive member through the first end of the inner periphery of the drive member.

22. The ratcheting wrench as claimed in claim 21, wherein the drive member has a shoulder on the outer periphery and located outside of the head, with the drive retainer being a ring fixedly mounted around said outer periphery of the drive member and abutting against the shoulder, the stop being located on the inner periphery of the drive member and distal to the flange.

23. The ratcheting wrench as claimed in claim 20 wherein the flange is integrally formed as a unitary, inseparable component at the one of the first and second ends of the outer periphery of the drive member.

* * * * *